US008888206B2

(12) United States Patent
Oe et al.

(10) Patent No.: US 8,888,206 B2
(45) Date of Patent: Nov. 18, 2014

(54) PRINTING APPARATUS

(71) Applicant: Seiko Epson Corporation, Tokyo (JP)

(72) Inventors: Kenichi Oe, Nagano-ken (JP); Noboru Asauchi, Nagano-ken (JP); Yasuhiko Kosugi, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 137 days.

(21) Appl. No.: 13/663,614

(22) Filed: Oct. 30, 2012

(65) Prior Publication Data

US 2013/0113853 A1 May 9, 2013

(30) Foreign Application Priority Data

Nov. 4, 2011 (JP) ..... 2011-242402

(51) Int. Cl.
*B41J 29/38* (2006.01)
*B41J 29/13* (2006.01)
*B41J 2/175* (2006.01)

(52) U.S. Cl.
CPC ..... *B41J 2/1753* (2013.01); *B41J 29/13* (2013.01); *B41J 2/17553* (2013.01); *B41J 2/17546* (2013.01)
USPC ..... 347/6

(58) Field of Classification Search
CPC .. B41J 2/0451; B41J 2/04541; B41J 2/04543; B41J 2/04563; B41J 2/0458; B41J 2/04581; B41J 2/04591; B41J 2/125; B41J 2/14024; B41J 2/1603; B41J 2/1623; B41J 2/1628; B41J 2/1631; B41J 2/175; B41J 2/17509; B41J 2/17513; B41J 2/1752; B41J 2/17523; B41J 2/17546; B41J 2/17553; B41J 2/17556; B41J 2/17566; B41J 2/17596; B41J 2/18; B41J 2/2135; B41J 29/38; B41J 29/393; B41J 2202/20
USPC ..... 347/5–20, 84–86
See application file for complete search history.

(56) References Cited

U.S. PATENT DOCUMENTS

| | | | | |
|---|---|---|---|---|
| 2001/0012026 | A1* | 8/2001 | Kobayashi et al. | 347/19 |
| 2002/0016893 | A1 | 2/2002 | Asauchi | |
| 2003/0002080 | A1 | 1/2003 | Asauchi | |
| 2003/0011654 | A1* | 1/2003 | Asauchi | 347/19 |
| 2006/0139422 | A1* | 6/2006 | Hatasa et al. | 347/86 |
| 2007/0126770 | A1* | 6/2007 | Asauchi | 347/19 |
| 2007/0149044 | A1* | 6/2007 | Asauchi | 439/534 |
| 2010/0289847 | A1* | 11/2010 | Ishizawa et al. | 347/19 |

FOREIGN PATENT DOCUMENTS

| | | |
|---|---|---|
| JP | 03-284953 | 12/1991 |
| JP | 2002-014870 | 1/2002 |
| WO | 02/40275 A1 | 5/2002 |

* cited by examiner

*Primary Examiner* — Manish S Shah
*Assistant Examiner* — Roger W Pisha, II

(57) ABSTRACT

A printing apparatus includes a printing material container 100 including a storage device 203, a plurality of storage device terminals, a first and a second individual mounting detection terminal DT1, DT2, a first and a second cartridge out detection terminal CO1, CO2; an individual mounting detection portion 330; a cartridge out detection portion 340; a storage portion 310; and a controller 350. In an energy-saving mode, the controller 350 sets the individual mounting detection portion 330 to a disabled state and sets the cartridge out detection portion 340 to an enabled state, and if the cartridge out detection portion 340 detects a cartridge out state, writes that detection result to the storage portion.

8 Claims, 11 Drawing Sheets

| CO DETECTION | DT DETECTION | COMPREHENSIVE EVALUATION | | PROCESSING AFTER EVALUATION |
|---|---|---|---|---|
| All I/Cs MOUNTED | All I/Cs MOUNTED | CASE 1 | DETERMINE THAT ALL I/Cs ARE PROPERLY MOUNTED | |
| All I/Cs MOUNTED | NOT MOUNTED I/C(s) PRESENT | CASE 2 | DETERMINE THAT I/Cs JUDGED TO BE NOT MOUNTED IN DT DETECTION ARE NOT MOUNTED | OUTPUT IDENTIFICATION INFORMATION OF I/Cs DETERMINED TO BE NOT MOUNTED |
| NOT MOUNTED I/C(s) PRESENT | All I/Cs MOUNTED | CASE 3 | DETERMINE THAT THERE'S I/C(s) WITH DEFECT TERMINAL CONTACTS | ACCESS STORAGE DEVICES OF ALL I/Cs |
| NOT MOUNTED I/C(s) PRESENT | NOT MOUNTED I/C(s) PRESENT | CASE 4 | DETERMINE THAT I/Cs JUDGED TO BE NOT MOUNTED IN DT DETECTION ARE NOT MOUNTED | OUTPUT IDENTIFICATION INFORMATION OF I/Cs DETERMINED TO BE NOT MOUNTED |

FIG. 9

PRINTING APPARATUS

BACKGROUND

1. Technical Field

The present invention generally relates to printing apparatuses.

2. Background Art

In printing apparatuses that use ink cartridges (printing material containers) that are mounted in a removable manner, it is necessary to detect whether the ink cartridges are mounted or not, in order to prevent that a printing process is carried out while any of the ink cartridges is not mounted.

With regard to this issue, for example, JP-A-2002-14870 describes a technique of detecting whether an ink cartridge is mounted or not through the presence of electrical conduction between a terminal on the printer apparatus side and a terminal on the ink cartridge side. Moreover, JP-A-3-284953 describes a technique of simultaneously detecting a remaining ink amount and detecting whether an ink cartridge is mounted or not. However, these techniques entail problems in that ink cartridges that are not mounted cannot be identified, and the power consumption becomes large.

SUMMARY

In accordance with some aspects of the invention, it is possible to provide a printing apparatus that can efficiently and reliably detect the presence of a printing material container.

According to one aspect of the invention, a printing apparatus includes a printing material container including a storage device, a plurality of storage device terminals that are connected to the storage device, a first individual mounting detection terminal, a second individual mounting detection terminal, a first cartridge out detection terminal, and a second cartridge out detection terminal; an individual mounting detection portion that is connected to the second individual mounting detection terminal and that individually detects a mounted state or a non-mounted state of the printing material container; a cartridge out detection portion that is connected to the first cartridge out detection terminal and the second cartridge out detection terminal, and that detects a cartridge out state of the printing material container; a storage portion that stores a detection result in case that the cartridge out detection portion detects a cartridge out state; and a controller; wherein, in an energy-saving mode, the controller sets the individual mounting detection portion to a disabled state and sets the cartridge out detection portion to an enabled state, and if the cartridge out detection portion detects a cartridge out state, writes that detection result to the storage portion, and when returning from the energy-saving mode to the regular mode, the controller sets the individual mounting detection portion to the enabled state and accesses the storage portion, and if the detection result is stored in the storage portion, the controller determines that there is a cartridge out state.

According to the aspect of the invention described above, an individual mounting detection is not carried out in the energy-saving mode, so that the power consumption can be decreased. On the other hand, by carrying out a cartridge out detection with low energy consumption in the energy-saving mode, it is possible to monitor the mounting state of the printing material container while keeping the power consumption low. And if a cartridge out state is detected, this detection result is stored in the storage portion, and upon returning to the regular mode, this detection result is read out, so that it can be determined whether the printing material container is in the mounted state or not. As a result, the mounted state of the printing material container can be detected efficiently and reliably, so that it is possible to realize a printing apparatus with high reliability and high efficiency.

It is preferable that, when returning from the energy-saving mode to the regular mode, the controller may determine that a cartridge out state is present if the detection result is stored in the storage portion, even if the cartridge out detection portion does not detect a cartridge out state.

Thus, when returning to the regular mode, it is possible to determine whether the printing material container is in the mounted state or not, based on the detection result of the cartridge out detection in the energy-saving mode, so that the mounting state of the printing material container can be monitored reliably.

It is preferable that, in the regular mode, if the individual mounting detection portion has detected the non-mounted state of the printing material container, the controller may output identification information of the printing material container that has been determined to be in the non-mounted state.

Thus, based on the identification information that is output, it is possible to notify the user as to which one of the printing material containers is in the non-mounted state.

It is preferable that, if a plurality of printing material containers are to be detected by the individual mounting detection portion, and if, in the regular mode, the individual mounting detection portion detects that the plurality of printing material containers to be detected are in the mounted-state, and the cartridge out detection portion detects a cartridge out state, then the controller may access the storage devices of the plurality of printing material containers to be detected, determine that any of the printing material containers whose storage device cannot be accessed are in the non-mounted state, and output identification information of those of the printing material containers that have been determined to be in the non-mounted state.

Thus, even if the individual mounting detection portion does not detect the non-mounted state of any of the printing material containers, the printing material containers whose storage device cannot be accessed can be determined to be in the non-mounted state, so that it is possible to reliably monitor the mounting state of the printing material containers.

It is preferable that, if the controller attempts to access the storage devices of the plurality of printing material containers to be detected, and can access the storage devices of all of the plurality of printing material containers to be detected, or cannot access the storage devices of any of the plurality of printing material containers to be detected, then the controller may output identification information of the plurality of printing material containers to be detected.

Thus, it is possible to notify the user of the possibility that there is a problem, such as a contact defect of the terminals, in the plurality of printing material containers that are to be detected.

It is preferable that the controller may display on a display portion mounting information, which is information on whether the printing material container is in the mounted state or not, based on the identification information.

Thus, it is possible to notify the user of information relating to the mounting or non-mounting of the printing material containers, so that the user can confirm as to whether the printing material container is mounted, or can undertake suitable measures, such as, exchanging the printing material container having a problem.

It is preferable that the printing apparatus may further include a voltage application portion for applying a mounting detection voltage to the first individual mounting detection terminal; the printing material container may include a mounting detection resistor element that is provided between the first individual mounting detection terminal and the second individual mounting detection terminal; and the individual mounting detection portion may individually detect the mounted state or the non-mounted state of the printing material container, based on the mounting detection voltage and a current that flows through the mounting detection resistor element.

Thus, it is possible to specify any of the printing material containers having a problem, such as, a printing material container that is not mounted or has a contact defect at the terminals, in the printing apparatus in which a plurality of printing material containers are mounted, and notify the user of such a problem.

It is preferable that, if first to n-th printing material containers (where n is an integer of 2 or greater) are to be detected by the cartridge out detection portion, then the cartridge out detection portion may include a first terminal that is connected to the first cartridge out detection terminal of the first printing material container, and a second terminal that is connected to the second cartridge out detection terminal of the n-th printing material container, the first cartridge out detection terminal of the i-th printing material container (where "i" is an integer with $1<i<n$) among the first to n-th printing material containers may be connected to the second cartridge out detection terminal of the (i−1)-th printing material container, and the second cartridge out detection terminal of the i-th printing material container may be connected to the first cartridge out detection terminal of the (i+1)-th printing material container, and the cartridge out detection portion may detect a cartridge out state by detecting electrical conduction between the first terminal and the second terminal.

Thus, in a printing apparatus with a plurality of printing material containers mounted thereon, if at least one of the printing material containers is in a non-mounted state or has a contact defect at the terminals thereof, then the non-mounted state or the defect can be detected.

BRIEF DESCRIPTION OF THE DRAWINGS

FIG. 9 is a diagram illustrating the comprehensive evaluation.

DESCRIPTION OF EXEMPLARY EMBODIMENTS

The following is a detailed explanation of preferred embodiments of the invention. It should be noted that the embodiments described below do not limit the scope of the invention as stated in the appended claims in any way, and none of the structure described in the following embodiments is indispensable as a means for solving the problems addressed by the invention.

1. Printing Apparatus

Figure 1:
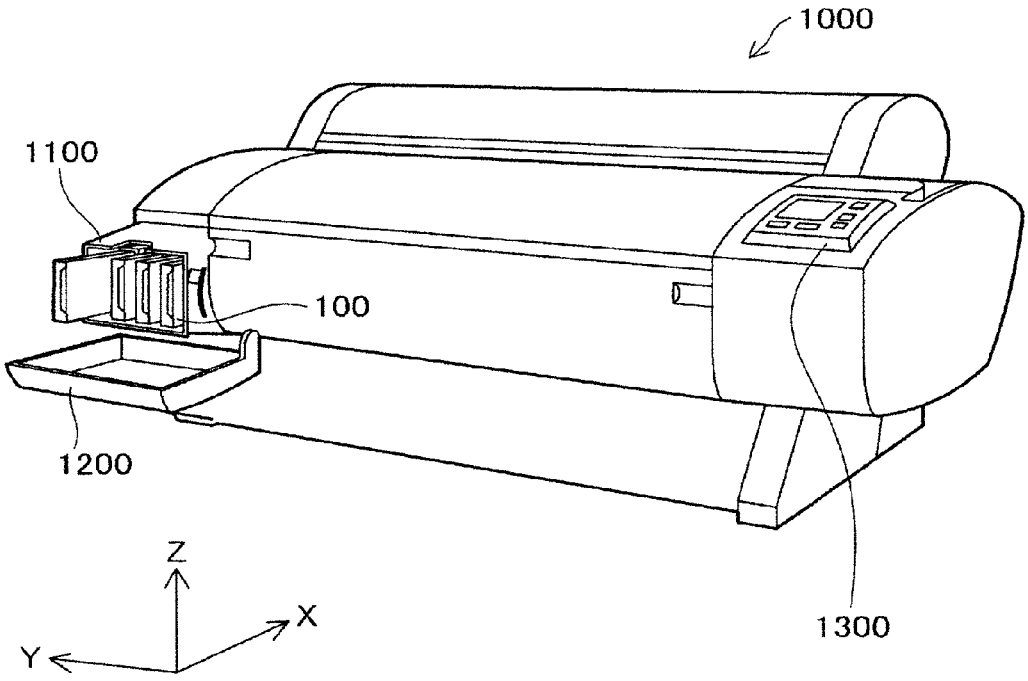
FIG. 1 is a perspective view showing a configuration example of a printing apparatus.

FIG. 1 is a perspective view showing a configuration example of a printing apparatus in accordance with one embodiment. A printing apparatus 1000 includes a cartridge mounting portion 1100 to which a printing material container (ink cartridge) can be mounted, a pivotable cover 1200, and an operation panel 1300. The cartridge mounting portion 1100 is also referred to as "cartridge holder" or simply as "holder." In the example shown in FIG. 1, four printing material containers can be mounted individually to the cartridge mounting portion 1100, in a manner removable from the printing apparatus 1000. For example, four printing material containers 100, that is, black, yellow, magenta and cyan printing material containers 100 can be mounted. The cover 1200 may be omitted. The operation panel 1300 is an input device with which a user can input various instructions or settings, and includes a display portion for displaying various notifications to the user.

Figure 2B:
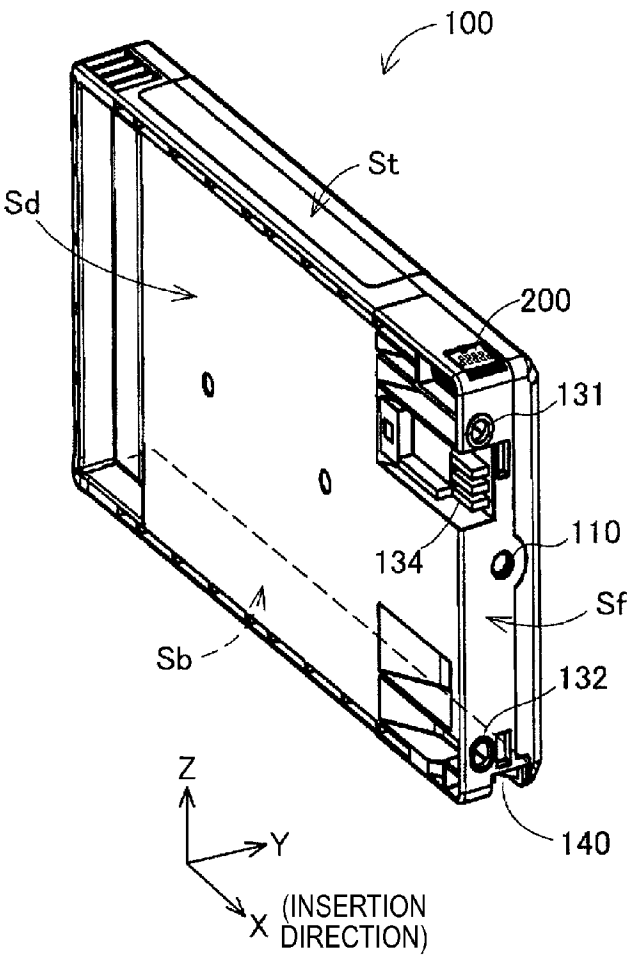
FIGS. 2A and 2B are perspective views showing the outer appearance of a printing material container.
Figure 2A:
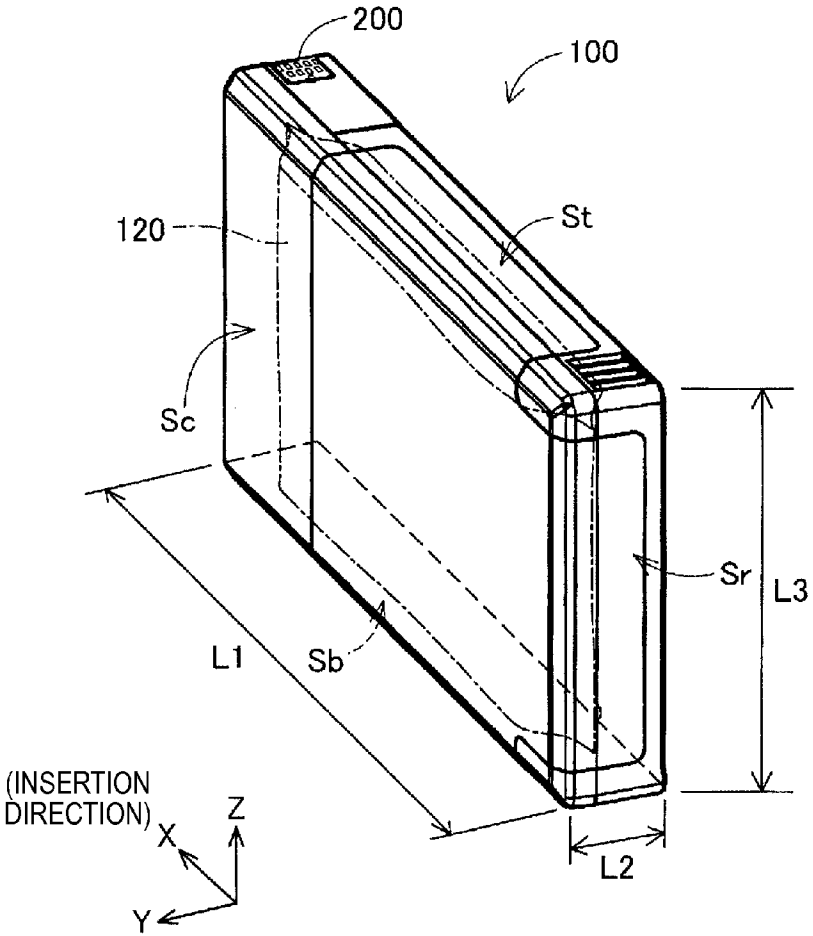

FIGS. 2A and 2B are perspective views showing the outer appearance of one of the printing material containers 100. The X,Y and Z axes in FIGS. 2A and 2B correspond to the X, Y and Z axes in FIG. 1. The printing material container 100 has a flat, substantially cuboid outer shape. Of its three dimensions L1, L2 and L3, its length L1 (size in insertion direction) is the largest, its width L2 is the smallest and its height L3 is between the length L1 and the width L2.

The printing material container 100 has a front face (first face) Sf, a rear face (second face) Sr, a top face (third face) St, a bottom face (fourth face) Sb, and two side faces (fifth and sixth faces) Sc and Sd. An ink containing compartment (also referred to as "ink containing pouch") 120 that is made of a flexible material is arranged inside the printing material container 100. The front face Sf has two positioning holes 131, 132 and an ink supply port 110. A circuit board (also simply "board") 200 is provided at the top face St. The circuit board 200 is provided with a non-volatile storage device 203 for storing information regarding the ink. The first side face Sc and the second side face Sd oppose each other and are perpendicular to the front face Sf, the top face St, the rear face Sr and the bottom face Sb. An indented fitting portion 134 is arranged at the position where the second side face Sd and the front face Sf meet.

Figure 3A:
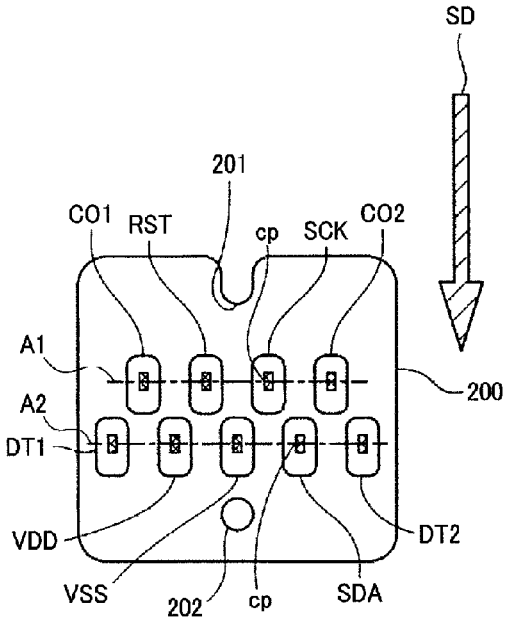
FIG. 3A shows a configuration example of a board in accordance with an embodiment of the invention.
Figure 3B:
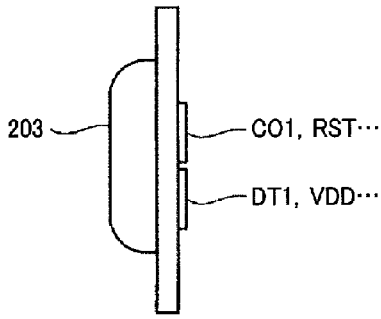
FIG. 3B is a diagram showing the board from the side.

FIG. 3A shows a configuration example of the board 200 of the present embodiment. The surface of the board 200 is exposed to the outside when the board 200 is mounted to the printing material container 100. FIG. 3B is a diagram showing the board 200 from the side. A boss groove 201 is formed at the upper edge of the board 200, and a boss hole 202 is formed at the lower edge of the board 200.

The arrow SD in FIG. 3A represents the mounting direction in which the printing material container 100 is mounted to the cartridge mounting portion 1100. This mounting direction SD coincides with the mounting direction (X direction)

of the printing material container shown in FIG. 2. The board 200 has on its rear side a storage device 203, and is provided on its front side with a group of terminals made up of nine terminals. The storage device 203 stores information relating to the printing material container 100 and information relating to the ink that is contained in the printing material container 100 (for example, ink amount information, remaining ink amount or ink consumption amount). These terminals are formed in a substantially rectangular shape and are arranged in two rows that are substantially perpendicular to the mounting direction SD.

The board 200 is provided with a plurality of storage device terminals RST, SCK, SDA, VDD and VSS, a first individual mounting detection terminal DT1, a second individual mounting detection terminal DT2, a first cartridge out detection terminal CO1, and a second cartridge out detection terminal CO2.

Of the two rows, the row that is arranged on the proximal side with respect to the mounting direction SD (in FIG. 3A, this is the upper row) is referred to as the upper row A1 (first row), and the row that is arranged on the distal side with respect to the mounting direction SD (in FIG. 3A, this is the lower row) is referred to as the lower row A2 (second row). It is also possible to think of these rows A1 and A2 as being formed by a plurality of terminal contact portions cp.

The terminals CO1, RST, SCK and CO2 forming the upper row A1 and the terminals DT1, VDD, VSS, SDA and DT2 forming the lower row A2 have the following functionality (application):

Upper Row A1

(1) first cartridge out detection terminal CO1

(2) reset terminal RST (3) clock terminal SCK (4) second cartridge out detection terminal CO2

Lower Row A2

(5) first individual mounting detection terminal DT1

(6) power source terminal VDD (7) ground terminal VSS (8) data terminal SDA (9) second individual mounting detection terminal DT2

As explained later, the first and second individual mounting detection terminals DT1 and DT2 are used when individually detecting whether or not the printing material containers 100 are mounted correctly to the cartridge mounting portion 1100. Moreover, the first and second cartridge out detection terminals CO1 and CO2 are used to detect that at least one printing material container is in a non-mounted state (e.g., not mounted). The other five terminals RST, SCK, VDD VSS and SDA are terminals for the storage device 203 (storage device terminals) and are also referred to as "memory terminals."

The memory terminals RST, SCK, VDD, VSS and SDA are each electrically connected by wirings not shown in the drawing to the storage device 203 provided on the rear side of the board 200. The board 200 is furthermore provided with a resistor element for mounting detection that is not shown in the drawings, one end of the resistor element for mounting detection being connected to the first individual mounting detection terminal DT1 and the other end being connected to the second individual mounting detection terminal DT2.

Each of the terminals includes, at its center, a contact portion cp connecting it to the corresponding terminal of the plurality of terminals on the side of the printing apparatus.

Figure 4:
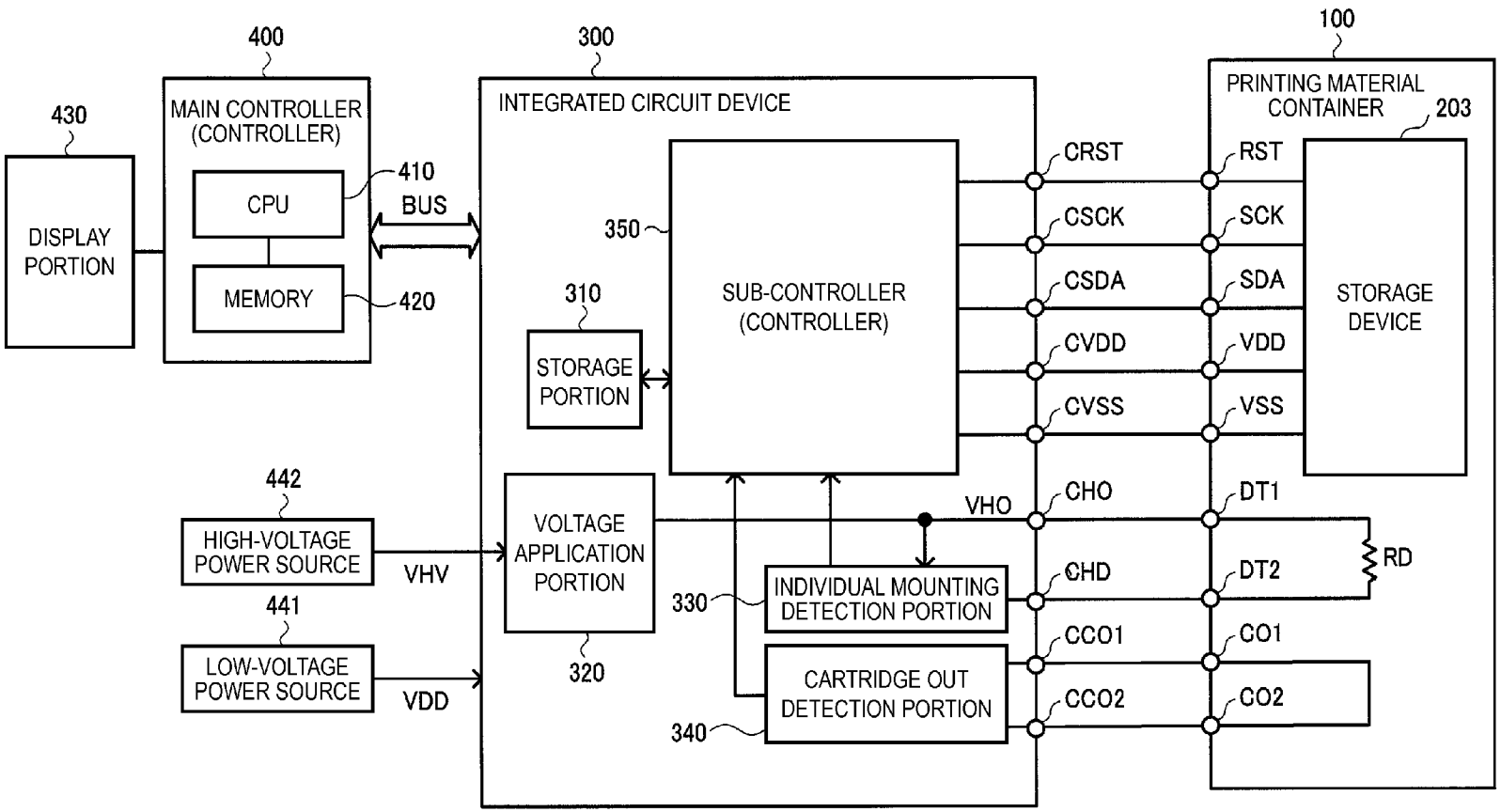
FIG. 4 shows a basic configuration example of the electrical configuration of a printing apparatus.

FIG. 4 shows a basic configuration example of the electrical configuration of the printing apparatus according to the present embodiment. The printing apparatus of this configuration example includes the printing material container (ink cartridge) 100, an integrated circuit device 300, a main controller 400 (in a broad sense, a controller), a low-voltage power source 441, a high-voltage power source 442, and a display portion 430. The printing material container 100 includes the storage device 203, the plurality of storage device terminals RST, SCK, SDA, VDD and VSS, the first and second individual mounting detection terminals DT1 and DT2, and the first and second cartridge out detection terminals CO1 and CO2. The integrated circuit device 300 includes a storage portion 310, a voltage application portion 320, an individual mounting detection portion 330, a cartridge out detection portion 340, and a sub-controller 350 (more generally speaking, a controller). It should be noted that the printing apparatus according to the present embodiment is not limited to the configuration shown in FIG. 4, and a variety of modifications are possible, for example, by leaving out a part of its structural elements, replacing a part of its structural elements with other elements, or adding further structural elements.

The main controller 400 (more generally speaking, the controller) includes a CPU 410 and a memory 420, and controls the printing process. Moreover, the main controller 400 performs the necessary communication with the integrated circuit device 300 through a bus BUS. Based on identification information of the printing material containers 100 (color information or information relating to the mounting position), the main controller 400 (more generally speaking, the controller) controls the display of mounting information, which is information relating to the mounted state or non-mounted state of printing material containers 100 on the display portion 430. The identification information of the printing material container 100 may be information with which one of the plurality of printing material containers mounted in the printing apparatus can be specified. For example, it may be ID information of the printing material containers or ink color information. In the configuration example shown in FIG. 4, the controller is divided into a main controller 400 and a sub-controller 350, but it may also be constituted by a single controller.

The display portion 430 is for displaying to the user various notifications, such as an operation state of the printing apparatus 1000 or a mounting state of the cartridges. The display portion 430 may be provided in the operation panel 1300 in FIG. 1, for example.

The low-voltage power source 441 generates a low-voltage power-source voltage (first power-source voltage) VDD. The first power-source voltage VDD is an ordinary power-source voltage (rated 3.3 V) used for logic circuits. The high-voltage power source 442 generates a high-voltage power-source voltage (second power-source voltage) VHV. The second power-source voltage VHV is a high voltage (rated 42 V, for example) that is used for ejecting ink by driving a print head, and is used to generate a mounting detection voltage VHO that is applied to the first individual mounting detection terminal DT1. These voltages VDD and VHV are supplied to the integrated circuit device 300, and are also supplied to other circuits, as necessary. More specifically, for example the high-voltage power-source voltage VHV is supplied by the high-voltage power source 442 to the voltage application portion 320 of the integrated circuit device 300. Then, the mounting detection voltage VHO that is output from the voltage application portion 320 is supplied to the individual mounting detection portion 330, and is supplied via the mounting detection output terminal CHO to the first individual mounting detection terminal DT1 of the printing material container 100. The mounting detection voltage VHO is higher than the power source voltage on the high potential side (for example, 3.3 V) that is supplied to the storage device 203.

The storage device 203 is a non-volatile memory that can store information (printing material information) relating to the printing material that is contained in the printing material container 100, and can furthermore store information (printing material container information) relating to the printing material container itself. The printing material information may include, for example, ink color information or ink consumption amount information or the like. The printing material container information may include ID information and manufacturing information on the printing material container, for example. The plurality of storage device terminals, that is, the reset terminal RST, the clock terminal SCK, the power source terminal VDD, the data terminal SDA, and the ground terminal VSS are electrically connected to the storage device 203. The storage device 203 does not have any address terminals, but determines the memory cell to be accessed based on the number of pulses of the clock signal that is input from the clock terminal SCK and command data that is input from the data terminal SDA, receives the data from the data terminal SDA in synchronization with the clock signal, or sends data from the data terminal SDA. The clock terminal SCK is used for supplying the clock signal from the sub-controller 350 to the storage device 203.

The power-source voltage (for example, 3.3 V) and the ground voltage (0 V) for driving the storage device 203 are respectively supplied to the power source terminal VDD and the ground terminal VSS. The power-source voltage for driving the storage device 203 is generated and supplied by the sub-controller 350 based on the low-voltage power source 441.

The data terminal SDA is used for exchanging data signals between the sub-controller 350 and the storage device 203. The reset terminal RST is used for supplying a reset signal from the sub-controller 350 to the storage device 203.

The first and second individual mounting detection terminals DT1 and DT2 are used when individually detecting whether the printing material container 100 is mounted to the cartridge mounting portion 1100. A mounting detection resistor element RD is provided between the first individual mounting detection terminals DT1 and the second individual mounting detection terminal DT2.

The individual mounting detection portion 330 is connected to the second individual mounting detection terminal DT2 and individually detects whether the printing material container 100 is in the mounted state or not. More specifically, it detects whether the printing material container 100 is mounted based on the mounting detection voltage VHO that is output from the voltage application portion 320 and the current flowing through the mounting detection resistor element RD. That is to say, the mounting detection voltage VHO that is output from the voltage application portion 320 is applied to the first individual mounting detection terminal DT1, so that a voltage is applied to the mounting detection resistor element RD and a current flows therethrough, and this current flows to the mounting detection input terminal CHD. By detecting this current with the individual mounting detection portion 330, it is detected whether the printing material container is mounted. With the individual mounting detection portion 330, it is possible to specify those mounting positions in the cartridge mounting portion 1100, in which the printing material container 100 is in the non-mounted state. The mounting positions of the printing material containers 100 in the cartridge mounting portion 1100 depend on their respective colors. Therefore, for example, by specifying the mounting position of a non-mounted printing material container, it is possible to determine that the printing material container of the color that should be mounted to that mounting position is in the non-mounted state. This method for individual mounting detection is explained later in more detail.

The first and second cartridge out detection terminals CO1 and CO2 are electrically connected to each other by wiring within the printing material container 100 (more specifically, the board 200).

The cartridge out detection portion 340 is connected via a first terminal CCO1 to the first cartridge out detection terminal CO1 and via a second terminal CCO2 to the second cartridge out detection terminal CO2, and detects a cartridge out state of the printing material container 100. More specifically, by detecting whether there is an electrical connection between CCO1 and CCO2, the cartridge out detection portion 340 can detect whether CO1 and CO2 are in electrical contact with the corresponding terminals of the cartridge mounting portion 1100, that is, whether the printing material container 100 is in a mounted state or not. If at least one of the plurality of printing material containers 100 is in a non-mounted state, then the cartridge out detection portion 340 can detect this as a "cartridge out state." However, since it cannot specify the position of each of the non-mounted printing material containers 100 in the cartridge mounting portion 1100, it cannot determine which of the printing material containers 100 are in the non-mounted state.

Note that in the following explanation, the detection by the individual mounting detection portion 330 is referred to as "individual mounting detection" or "DT detection", and the detection by the cartridge out detection portion 340 is referred to as "cartridge out detection" or "CO detection".

The individual mounting detection individually detects whether each of the printing material containers subject to detection is in a mounted-state or not, and if a plurality of printing material containers are subject to detection, it can determine as to which of these printing material containers are in a non-mounted state.

The cartridge out detection detects mounting or non-mounting of the printing material containers subject to detection. If a plurality of printing material containers are subject to detection, the cartridge out detection can be made when at least one of these printing material containers is in a non-mounted state. However, unlike the individual mounting detection, it cannot specify the printing material containers that are in the non-mounted state.

When the cartridge out detection portion 340 has detected a cartridge out state, the storage portion 310 stores the detection result. More specifically, when the cartridge out detection portion 340 has detected a cartridge out state while the printing apparatus is in an energy saving mode, the storage portion 310 stores the detection result. When returning from the energy saving mode to a regular mode, the detection result is read out by the sub-controller 350.

The sub-controller 350 (more generally speaking, the controller) is connected to a plurality of the storage device terminals (memory terminals) RST, SCK, VDD, VSS and SDA, and controls, together with the main controller 400, the reading or writing of data from or to the storage device 203. For example, if the main controller 400 performs control for writing or reading data to or from the storage device 203, the sub-controller 350 relays the communication of written data or read data.

Moreover, the sub-controller 350 performs the control of the detection by the individual mounting detection portion 330 and the control of the detection by the cartridge out detection portion 340, and judges as to whether a printing material container 100 is in the mounted-state or not. The sub-controller 350 can be realized by a logic circuit that is constituted by CMOS transistors, for example.

In the energy-saving mode, the sub-controller 350 (more generally speaking, the controller) interrupts the supply of the high voltage by the high-voltage power source 442, sets the individual mounting detection portion 330 to a disabled state and sets the cartridge out detection portion 340 to an enabled state, and if the cartridge out detection portion 340 has detected a cartridge out state, controls the writing of this detection result into the storage portion 310. Moreover, when returning from the energy-saving mode to the regular mode, the sub-controller 350 sets the individual mounting detection portion 330 to the enabled state and accesses the storage portion 310. If a detection result is stored in the storage portion 310, the sub-controller 3350 judges that there is a cartridge out state. It should be noted that details of the detection control with the sub-controller 350 are explained further below.

Thus, since the individual mounting detection using the high voltage (for example, 42 V) is not carried out in the energy saving mode, the power consumption can be reduced. On the other hand, by carrying out the cartridge out detection using the lower voltage (for example, 3.3 V) also in the energy-saving mode, the mounting state of the printing material container 100 can be monitored while suppressing the power consumption to a low level. Then, if a cartridge out state is detected, the detection result is stored in the storage portion 310, and this detection result is read out when returning to the regular mode, so that it is possible to perform the proper processing, such as notifying the user.

The energy-saving mode is a mode in which the printing apparatus does not carry out print processing and the power consumption is decreased. For example, if a state in which the printing apparatus does not receive a print command from a personal computer continues for a certain time, then the energy-saving mode is set by the processing of the main controller 400 (more generally speaking, the controller).

The regular mode is a mode in which the printing apparatus carries out print processing, and is set, for example, when the power is turned on. Moreover, when the printing apparatus has been set to the energy-saving mode and receives a print command from a personal computer or the like, then the regular mode is restored from the energy-saving mode by processing of the main controller 400.

With the printing apparatus according to the present embodiment, the mounting state of the printing material containers can be monitored while keeping the power consumption in the energy-saving mode at a low level. On the other hand, in the regular mode, it is possible to carry out an individual mounting detection and specify the printing material containers that are in the non-mounted state. As a result, since the mounting state of the printing material containers can be reliably detected with high efficiency, it is possible to realize a printing apparatus that is highly reliable and very efficient.

Note that the controls that are carried out by the sub-controller 350, such as, for example, the individual mounting detection, the cartridge out detection and the overall determination as to the mounted state and the non-mounted state may also be carried out by the main controller 400. Moreover, the main controller 400 and the sub-controller 350 may also be constituted by a single controller. If they are constituted by a single controller, then the control with the main controller 400 and the sub-controller 350 is carried out similarly by the single controller to which they are combined.

Figure 5:
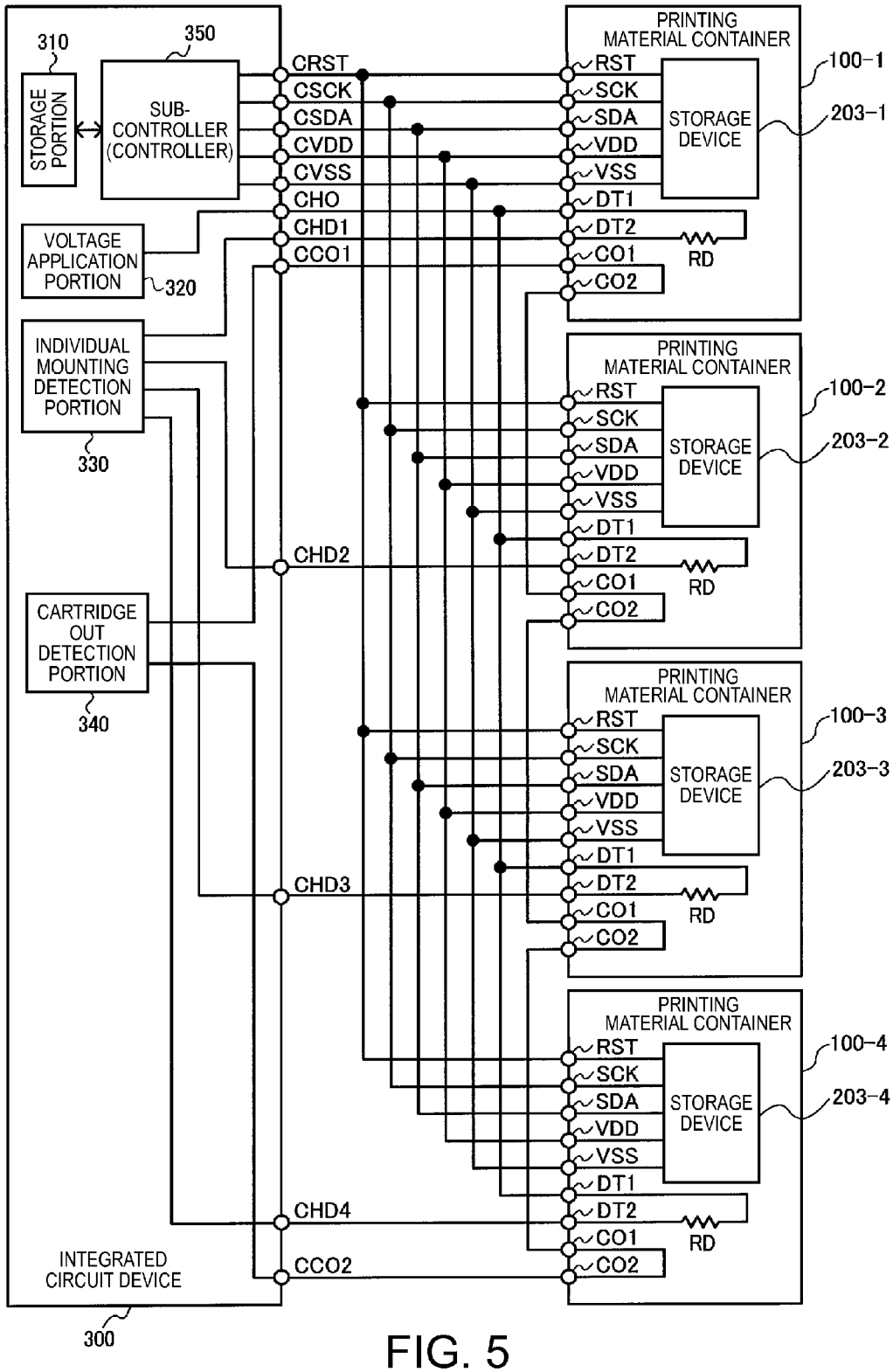
FIG. 5 shows a first configuration example of a printing apparatus.

FIG. 5 shows a first configuration example of a printing apparatus according to the present embodiment. The printing apparatus of the first configuration example includes four printing material containers 100-1 to 100-4, and an integrated circuit device 300. Although not shown in the drawings, the printing apparatus further includes the main controller 400 (in a broad sense, a controller), the low-voltage current source 441, the high-voltage current source 442, and the display portion 430. The integrated circuit device 300 includes the storage portion 310, the voltage application portion 320, the individual mounting detection portion 330, the cartridge out detection portion 340 and the sub-controller 350 (in a broad sense, a controller). The printing material containers 100-1 to 100-4 include storage devices 203-1 to 203-4.

It should be noted that the printing apparatus according to the present embodiment is not limited to the configuration shown in FIG. 5, and a variety of modifications are possible, for example, by leaving out a part of its structural elements, replacing a part of its structural elements with other elements, or adding further structural elements. For example, the number of the printing material containers 100 is not limited to four, and may be two, three, five or more.

The printing material containers 100-1 to 100-4 have a similar configuration as that shown in FIG. 4, so that their detailed description will be omitted. Also the configuration of the integrated circuit device 300 is similar to that shown in FIG. 4. However, it is provided with four mounting detection input terminals CHD1 to CHD4 corresponding to the four printing material containers 100-1 to 100-4. The individual mounting detection portion 330 distinguishes and detects the currents flowing from the four mounting detection input terminals CHD1 to CHD4. Thus, it can individually detect the mounted state and the non-mounted state of each of the printing material containers 100-1 to 100-4.

The voltage application portion 320 supplies the mounting detection voltage VHO via the mounting detection output terminal CHO to the first individual mounting detection terminal DT1 of each of the printing material containers 100-1 to 100-4. For example, if the printing material container 100-1 is mounted, a current flows through the mounting detection resistor RD of the printing material container 100-1, and this current flows through the mounting detection input terminal CHD1 to the individual mounting detection portion 330. By detecting this current, it is possible to detect that the printing material container 100-1 is mounted. Moreover, if, for example, the printing material container 100-2 is not mounted, then no current flows to the mounting detection input terminal CHD2, so that it is possible to detect that the printing material container 100-2 is in the non-mounted state.

If a first printing material container to an n-th printing material container (where n is an integer of 2 or more) are to be detected by the cartridge out detection portion 340, then the respective cartridge out detection terminals CO1 and CO2 of the n printing material containers are connected in a so-called daisy chain. That is to say, the first cartridge out detection terminal CO1 of the first printing material container 100-1 is connected to the first terminal CCO1 of the cartridge out detection portion 340, and the second cartridge out detection terminal CO2 of the n-th printing material container **100-*n* is connected to the second terminal CCO2 of the cartridge out detection portion 340. And the first cartridge out detection terminal CO1 of the i-th printing material container 100-*i* (where i is an integer of $1<i<n$) is connected to the second cartridge out detection terminal CO2 of the (i−1)-th printing material container 100-*i*−1. Moreover, the second cartridge out detection terminal CO2 of the i-th printing material container 100-*i* is connected to the first cartridge out detection terminal CO1 of the (i+1)-th printing material container 100-*i*+1**.

More specifically, as shown in FIG. 5, the first terminal CCO1 is connected to CO1 of the first printing material container 100-1, and CO2 of the first printing material container 100-1 is connected to CO1 of the second printing material container 100-2. And CO2 of the second printing material container 100-2 is connected to CO1 of the third printing material container 100-3, and CO2 of the third printing material container 100-3 is connected to CO1 of the fourth printing material container 100-4. And CO2 of the fourth printing material container 100-4 is connected to the second terminal CCO2. The cartridge out detection portion 340 detects a cartridge out state by detecting the electrical conduction between the first terminal CCO1 and the second terminal CCO2.

Thus, the cartridge out detection portion 340 can detect whether or not all of the four printing material containers 100-1 to 100-4 are mounted, by detecting the electrical conduction between the first terminal CCO1 and the second terminal CCO2. That is to say, if any one of the four printing material containers 100-1 to 100-4 is in the non-mounted state, then the cartridge out detection portion 340 can detect that. However, it cannot determine which of the printing material containers is in the non-mounted state.

Figure 6:
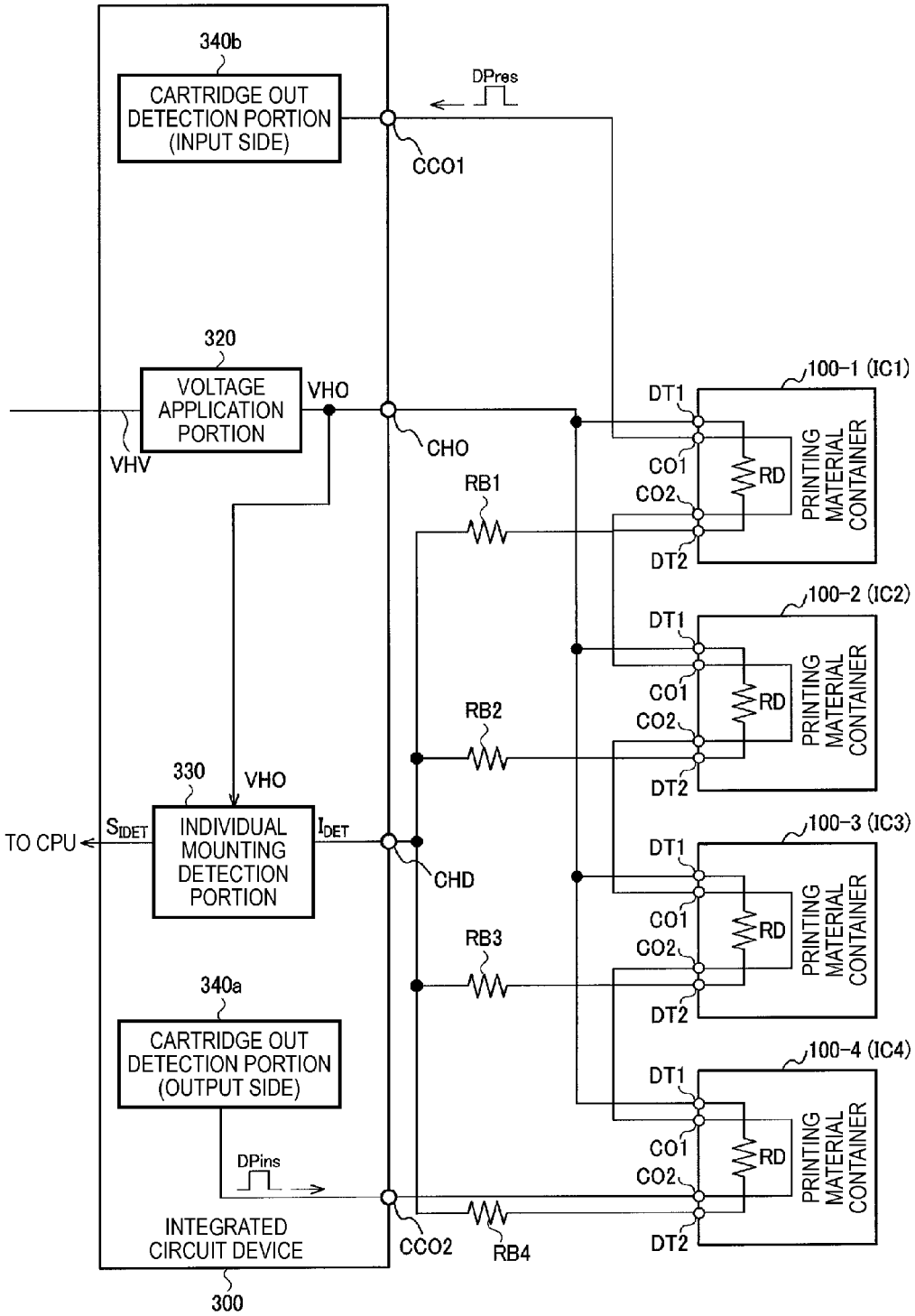
FIG. 6 shows a second configuration example of a printing apparatus.

FIG. 6 shows a second configuration example of a printing apparatus according to the present embodiment. In FIG. 6, only the configuration relating to the individual mounting detection and the cartridge out detection is shown. Although not shown in the drawings, an integrated circuit device 300 includes a storage unit 310 and a sub-controller 350 (in a broad sense, a controller). Although not shown in the drawings, printing material containers 100-1 to 100-4 include storage devices 203-1 to 203-4, respectively. It should be noted that the printing apparatus according to the present embodiment is not limited to the configuration shown in FIG. 6, and a variety of modifications are possible, for example by leaving out a part of its structural elements, replacing a part of its structural elements with other elements, or adding further structural elements. For example, the number of printing material containers is not limited to four, and may be two, three, five or more.

The printing material containers 100-1 to 100-4 have a similar configuration as that shown in FIG. 5, so that their detailed description will be omitted.

The second configuration example is different from the first configuration example, in that a single first mounting detection input terminal CHD is connected to the individual mounting detection portion 330. A resistor element RB1 is arranged between the individual mounting detection terminal DT2 of the printing material container 100-1 and the mounting detection input terminal CHD. Similarly, resistor elements RB2 to RB4 are arranged between the respective individual mounting detection terminals DT2 of the printing material containers 100-2 to 100-4 and the mounting detection input terminal CHD. The resistor elements RB1 to RB4 have mutually different resistance values. Thus, the individual mounting detection portion 330 is able to detect as to which position in the cartridge mounting portion 1100 a printing material container is in the non-mounted state. A technique for the individual mounting detection according to the second configuration example is explained in detail below.

In FIG. 6, the cartridge out detection portion 340 is shown, for convenience's sake, split up into a cartridge out detection portion (output side) 340*a* and a cartridge out detection portion (input side) 340*b*. Note that the cartridge out detection portions 340*a* and 340*b* can be realized by analog circuits and logic circuits that are constituted by CMOS transistors, for example.

The cartridge out detection with the cartridge out detection portion 340 (340*a* and 340*b*) is carried out as follows. If all of the four printing material containers 100-1 to 100-4 are mounted, then there is a state of electrical conduction from the cartridge out detection terminal CO1 of the printing material container 100-1 to the cartridge out detection terminal CO2 of the printing material container 100-4, as shown in FIG. 6. Consequently, a signal DPins that is output from the cartridge out detection portion (output side) 340*a* is detected as a signal DPres by the cartridge out detection portion (input side) 340*b*. On the other hand, if any one of the four printing material containers 100-1 to 100-4 is in the non-mounted state, then there is no state of electrical conduction, so that the cartridge out detection portion (input side) 340*b* does not detect the signal DPres. Thus, depending on whether the cartridge out detection portion (input side) 340*b* detects the signal DPres, it is possible to detect a cartridge out state. It should be noted that also the cartridge out detection in the first configuration example can be carried out similarly.

2. Mounting Detection

Figure 7:
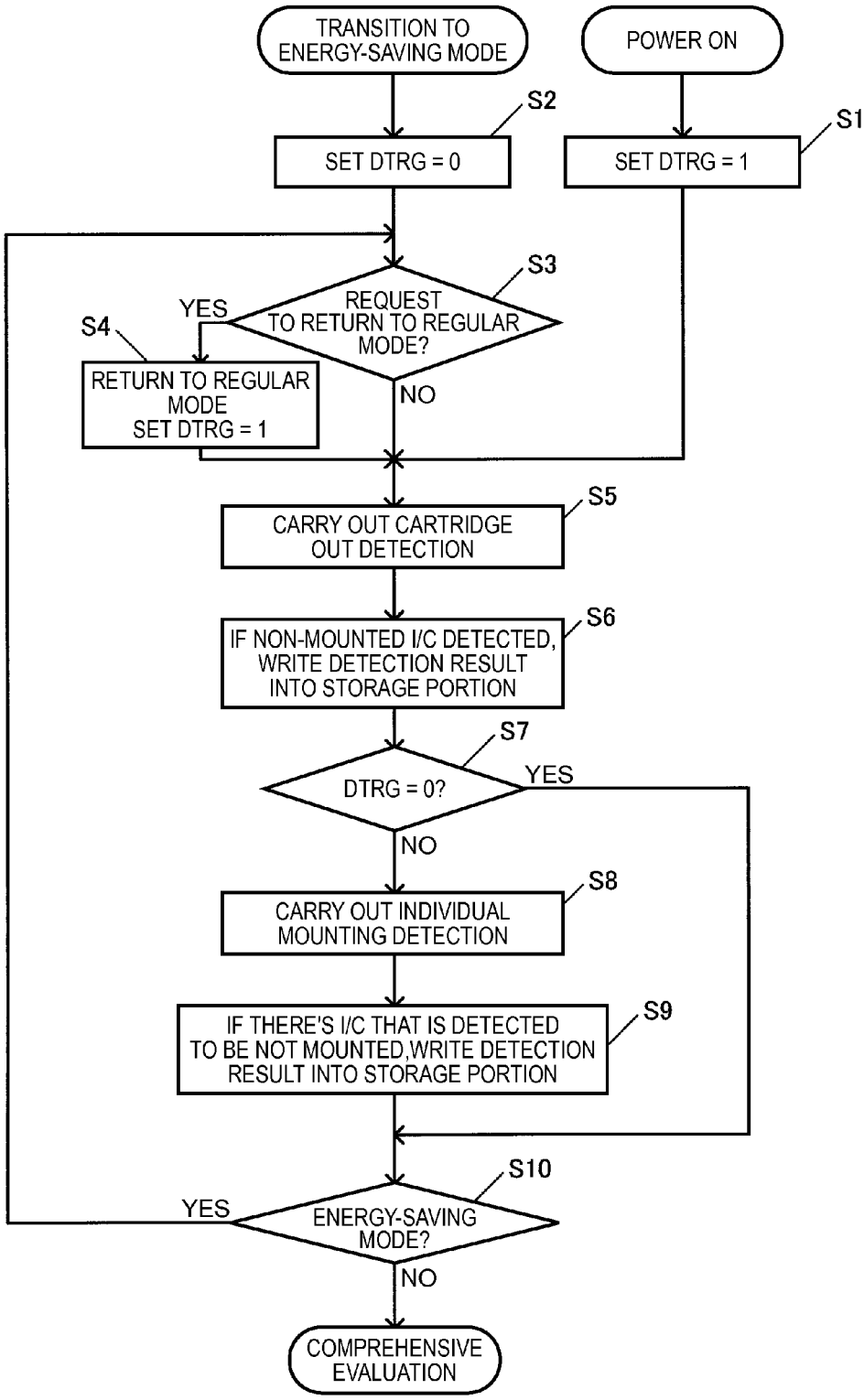
FIG. 7 is a flowchart of the individual mounting detection and the cartridge out detection.

FIG. 7 is a flowchart of the individual mounting detection and the cartridge out detection in the printing apparatus according to the present embodiment. The flow in FIG. 7 is controlled by the sub-controller 350 (or the main controller 400).

When the power of the printing apparatus is turned on, the printing apparatus is set into the regular mode, and the register value DTRG of a DT control register controlling the operation of the individual mounting detection portion 330 is set to "1" (Step S1). The DT control register is provided, for example, in the sub-controller 350, and if its register value is DTRG=1, then the individual mounting detection portion 330 is set to the enabled state. On the other hand, if the register value DTRG=0, then the individual mounting detection portion 330 is set to the disabled state. It should be noted that the cartridge out detection portion 340 is set to the enabled state regardless of the value of the register value DTRG.

Next, the procedure advances to Step S5, and a cartridge out detection (CO detection) is carried out by the cartridge out detection portion 340. Then, if a non-mounted state is detected by the CO detection, then this detection result is written into the storage portion 310 (Step S6).

In the next Step S7, it is judged whether the register value DTRG of the DT control register is zero or not. Since DTRG=1 in the regular mode, the procedure advances to Step S8, and the individual mounting detection (DT detection) with the individual mounting detection portion 330 is carried out. Then, if it is detected by the DT detection that a printing material container is not mounted, then the detection result is written into the storage portion 310 (Step S9).

In the next Step S10, it is judged whether the printing apparatus is in the energy-saving mode or not. In this case, it is in the regular mode, so that the procedure advances to a process of comprehensive evaluation. Details of the comprehensive evaluation are explained below.

The following is an explanation of the case that the printing apparatus is in the energy-saving mode. When the printing apparatus returns from the regular mode to the energy-saving mode, the register value DTRG of the DT control register is set to "0" (Step S2).

In the following Step S3, it is judged whether there is a request to return to the regular mode or not. If there is no return request, the procedure advances to Step S5, and the CO detection is carried out. Then, if a non-mounted state is detected by the CO detection, the detection result is written into the storage portion 310 (Step S6).

In the following Step S7, it is judged whether the register value DTRG of the DT control register is "0" or not. Since DTRG=0 in the energy-saving mode, the procedure advances to Step S10 without carrying out the individual mounting detection.

In Step S10, it is judged whether the printing apparatus is in the energy-saving mode or not. In this case, it is in the energy-saving mode, so that the procedure returns to Step S3, and if there is no request to return to the regular mode, then the CO detection is carried out again (Steps S5, S6). Thus, in the energy-saving mode, the CO detection is carried out repeatedly.

If there is a request to return from the energy-saving mode to the regular mode, then the procedure advances to Step S4 due to the judgment in Step S3, the printing apparatus returns to the regular mode, and the register value DTRG is set to "1". Then, after the CO detection has been carried out in Steps S5 and S6, the DT detection is carried out in Steps S8 and S9, and after that, the comprehensive evaluation is carried out.

Figure 8:
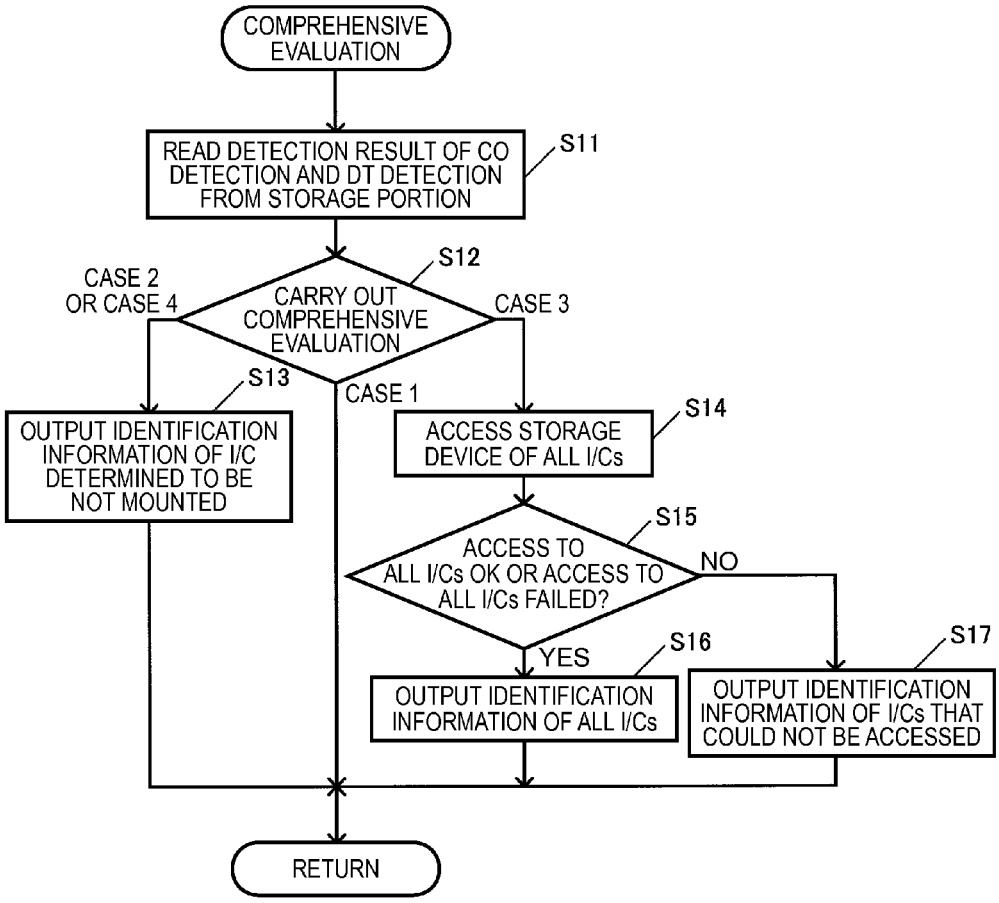
FIG. 8 is a flowchart of the comprehensive evaluation of the mounting detection.

FIG. 8 is a flowchart of the comprehensive evaluation of the mounting detection in the printing apparatus of the present embodiment. The flow in FIG. 8 is controlled by the sub-controller 350 (or the main controller 400).

FIG. 9 is a diagram illustrating the comprehensive evaluation. This comprehensive evaluation is carried out by the sub-controller 350 (or the main controller 400). It should be noted that in FIG. 8 and FIG. 9, the printing material container is denoted as "I/C".

In the first Step S11, the detection results from the cartridge out detection (CO detection) and the individual mounting detection (DT detection) are read out from the storage portion 310.

In the next Step S12, a comprehensive evaluation is carried out on the basis of the detection result that has been read out. Through this comprehensive evaluation, the four cases shown in FIG. 9 are evaluated.

In the comprehensive evaluation shown in FIG. 9, when the printing apparatus has returned from the energy-saving mode to the regular mode, even if the cartridge out detection portion 340 has not detected a cartridge out state, if a "cartridge out" detection result is stored in the storage portion 310, then a cartridge out state (non-mounted I/C present) is determined as the CO detection result. That is to say, even if a cartridge out state is not detected by the CO detection after returning to the regular mode, if a cartridge out state has been detected in the energy-saving mode, then there is the possibility that the contacts of the terminals are unstable, so that the comprehensive evaluation as "non-mounted I/C exists" is given by the CO detection.

Case 1 of the comprehensive evaluation is that both the CO detection and the DT detection return "all I/Cs mounted", and the result of the comprehensive evaluation is that all printing material containers are properly mounted.

Case 2 of the comprehensive evaluation is that the CO detection returns "all I/Cs mounted" and the DT detection returns "non-mounted I/C present". In this case, the CO detection terminals CO1, CO2 are in proper contact, but there is a printing material container in which the contact of the DT detection terminals DT1, DT2 is poor. In this case 2, the sub-controller 350 (or the main controller 400) gives the comprehensive evaluation that the printing material container that should be mounted in the mounting position where the DT detection indicates the non-mounted state, and outputs identification information including information on the ink color of the printing material container that has been determined to be in the non-mounted state (Step S13).

Case 3 of the comprehensive evaluation is that the CO detection returns "non-mounted I/C present" and the DT detection returns "all I/Cs mounted". In this case, there is a printing material container in which the contact of the CO detection terminals CO1, CO2 is poor, but it is not possible to specify this cartridge. To address this issue, the sub-controller 350 (or the main controller 400) accesses the storage devices 203 of all printing material containers that are subject to detection (Step S14). Then, if the storage devices 203 of all printing material containers that are subject to detection can be accessed, or if none of the storage devices 203 of the printing material containers that are subject to detection can be accessed, then identification information of all the printing material containers that are subject to detection is output (Steps S15, S16). On the other hand, if the storage devices 203 of a part of the printing material containers that are subject to detection cannot be accessed, the identification information of those of the printing material containers that could not be accessed is output (Step S17).

Case 4 of the comprehensive evaluation is that both the CO detection and the DT detection return "non-mounted I/C present." In this case, the result of the comprehensive evaluation is that the printing material containers that are detected to be in the non-mounted state by the DT detection are not mounted, and identification information of the printing material containers that are determined to be in the not-mounted state is output (Step S13).

Finally, depending on the state of the printing apparatus at that time (regular mode or energy-saving mode), the procedure returns to S1 or S2 in FIG. 7.

Based on the output identification information, the main controller generates mounting information (information for displaying the non-mounted cartridge(s) by color, information for displaying the position(s) of non-mounted cartridge (s) by color) to be displayed on the display portion 430 or to be displayed by the printer driver on a personal computer monitor, and displays this information on the display portion or monitor.

Thus, with the printing apparatus of the present embodiment, it can be comprehensively determined which of the printing material containers are in the mounted state and which are not, based on both the detection result of the CO detection and the detection result of the DT detection, so that the mounting state of the printing material containers can be reliably monitored. Moreover, also in the energy-saving mode, a CO detection is carried out, and its detection result is stored in the storage portion 310, and after returning to the regular mode, this detection result can be reflected in the comprehensive evaluation, so that a mounting detection with high energy efficiency becomes possible. As a result, it becomes possible to realize a printing apparatus that is highly reliable and highly efficient.

3. Details of Individual Mounting Detection

Figure 10A:
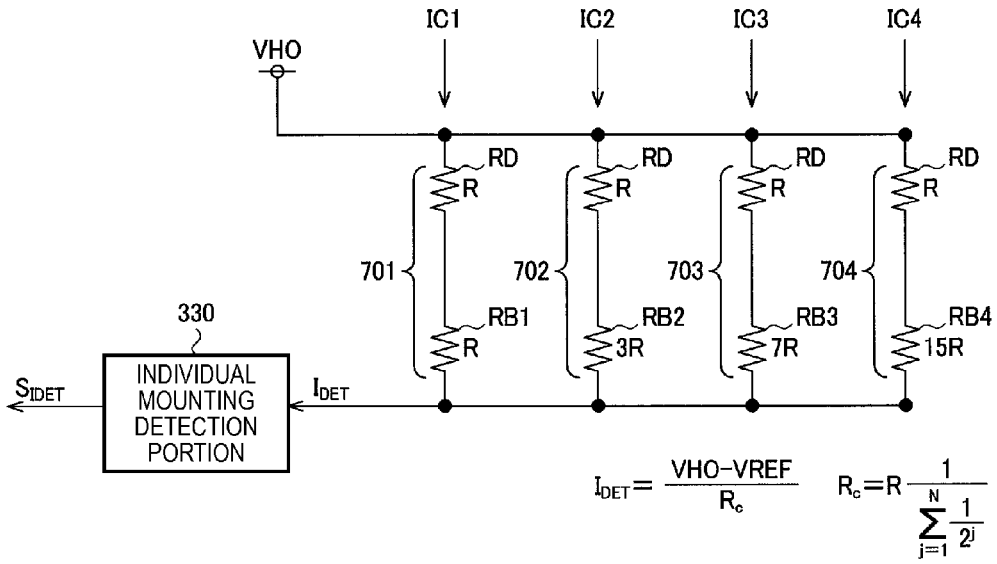
FIGS. 10A and 10B are diagrams illustrating a technique of the individual mounting detection with the second configuration example.
Figure 10B:
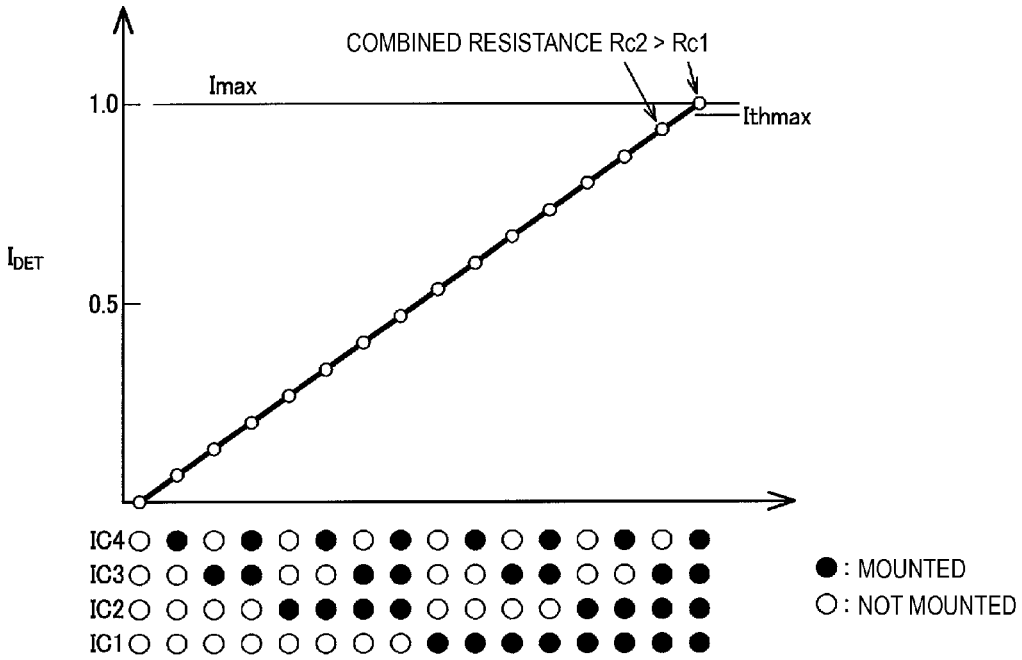

FIGS. 10A and 10B are diagrams illustrating a technique of the individual mounting detection with the second configuration example (FIG. 6) of the printing apparatus according to the present embodiment. FIG. 10A shows a state in which all cartridges IC1 to IC4 that can be mounted to the cartridge mounting portion 1100 of the printing apparatus are mounted. The resistance values of the mounting detection resistor elements RD of the four cartridges IC1 to IC4 are set to the same value R. Furthermore, resistor elements RB1 to RB4 are connected in series with the mounting detection resistor elements RD of the cartridges, respectively. The resistance values of these resistor elements RB1 to RB4 are set to mutually different values. More specifically, of the resistor elements RB1 to RB4 among the resistor elements RB1 to RB4, the resistance value of the resistor element RBn corresponding to the n-th cartridge ICn (with n=1 through 4) is set to $(2^n-1)R$ (where R is a constant value). As a result, due to the series connection between the mounting detection resistor element RD and the resistor element RBn within the n-th cartridge, a resistance with a resistance value $2^nR$ is formed. The resistance $2^nR$ for the n-th cartridge (with n=1 through N) is connected in parallel to the individual mounting detection portion 330. It should be noted that combined resistors 701 to 704 formed by the serial connection of the mounting detection resistor elements RD and the resistor elements RB1 to RB4 are also referred to simply as "resistors".

The detection current IDET that is detected by the individual mounting detection portion 330 has the value of (VHO−VREF)/Rc, that is, the voltage (VHO−VREF) divided by the combined resistance value Rc of the four resistors 701 to 704, where VREF is the bias voltage of the individual mounting detection portion 330. Here, when the number of cartridges is N, if all of the N cartridges are mounted, then the detection current IDET is given by the following equation:

$$I_{DET} = \frac{VHO - VREF}{R_c} \tag{1}$$

$$R_c = R\frac{1}{\sum_{j=1}^{N}\frac{1}{2^j}} \tag{2}$$

If at least one of the cartridges is in a non-mounted state, then the combined resistance value Rc rises accordingly, and the detection current IDET decreases.

FIG. 10B shows the relationship between the mounting state of the cartridges IC1 to IC4 and the detection current IDET. The horizontal axis in this drawing marks 16 mounting states, and the vertical axis marks the value of the detection current IDET at these mounting states. The 16 mounting states correspond to 16 combinations that are obtained by arbitrarily selecting one to four of the four cartridges IC1 to IC4. It should be noted that these individual combinations are also referred to as "subsets." The detection current IDET has a current value that can uniquely identify each of these 16 mounting states. In other words, the individual resistance values of the four resistors 701 to 704 corresponding to the four cartridges IC1 to IC4 are set such that the 16 mounting states that can be assumed by the four cartridges result in mutually different combined resistance values Rc.

If all four cartridges IC1 to IC4 are in the mounted state, then the detection current IDET becomes the maximum current Imax. On the other hand, in a state in which only the cartridge IC4 corresponding to the resistor 704 with the highest resistance value is in a non-mounted state, the detection current IDET is 0.93 times the maximum value Imax. Consequently, by determining whether the detection current IDET is equal to or larger than a threshold current Ithmax that has been set in advance as a value between these two current values, it is possible to detect whether all four cartridges IC1 to IC4 are mounted or not. It should be noted that the reason why a voltage VHO that is higher than the power-source voltage (about 3.3 V) of a regular logic circuit is used for the mounting detection is to increase the detection precision by widening the dynamic range of the detection current IDET.

The individual mounting detection portion 330 converts the detection current IDET into a digital detection signal SIDET, and sends this digital detection signal SIDET to the CPU 410 (FIG. 4). The CPU 410 is able to determine from the value of this digital detection signal SIDET which of the 16 mounting states is given. If it is determined that at least one of the cartridges is in a non-mounted state, then the CPU 410 displays information (text or images) representing this non-mounted state on the display portion 430, thus notifying the user thereof.

The above-described cartridge mounting detection processing utilizes the fact that the combined resistance value Rc is determined uniquely in accordance with the $2^N$ mounting states for the N cartridges, and the detection current IDET is determined uniquely in accordance with this. Here, an error margin of E is assumed for the resistance value of the resistors 701 to 704. Moreover, when Rc1 is a first combined resistance value in the state in which all cartridges IC1 to IC4 are mounted, and RC2 is a second combined resistance value in the state in which only the fourth cartridge IC4 is in the non-mounted state, then RC1<RC2 is given (see FIG. 10B). It is preferable that this relation RC1<RC2 is given even if the resistance values of the resistors 701 to 704 vary within the range of the error margin ±ϵ. In this case, considering the error margin ±ϵ, the worst case is that the first combined resistance value Rc1 takes on the maximum value Rc1max and the second combined resistance value Rc2 takes on the minimum value Rc2min. In order to make it possible to identify these combined resistance values Rc1max and Rc2min, the condition Rc1max<Rc2min should be satisfied. From this condition Rc1max<Rc2min, the following relation can be derived:

$$\varepsilon < \frac{1}{4(2^{N-1}-1)} \tag{3}$$

That is to say, if the error margin ±ϵ satisfies the Relation (3), then the combined resistance value Rc is always determined uniquely depending on the mounting state of the N cartridges, and accordingly, it can be guaranteed that the detection current IDET is determined uniquely. However, it is preferable that the error margin of the actual design resistance values is set to a smaller value than the value on the right side in Relation (3). Furthermore, although not discussed in the foregoing, it is also possible to set the error margin of the resistance values of the resistors 701 to 704 to a sufficiently small value (for example a value not greater than 1%).

Figure 11:
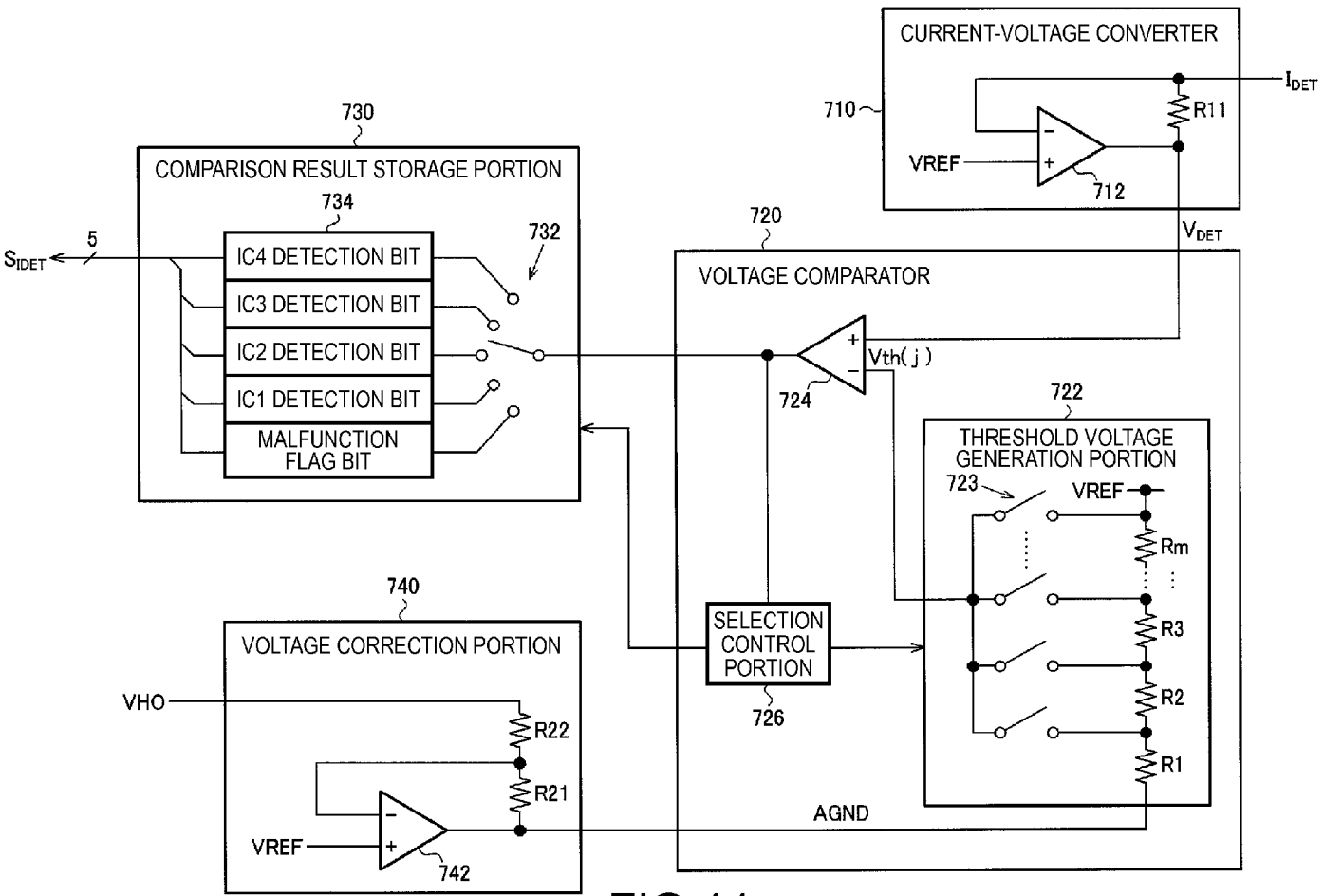
FIG. 11 is a detailed configuration example of the individual mounting detection portion in the second configuration example.

FIG. 11 is a detailed configuration example of the individual mounting detection portion 330 in the second configuration example of the printing apparatus of this embodiment (FIG. 6). The individual mounting detection portion 330 includes a current-voltage converter 710, a voltage comparator 720, a comparison result storage portion 730, and a voltage correction portion 740. It should be noted that the individual mounting detection portion 330 of this embodiment is not limited to the configuration in FIG. 11, and a variety of modifications are possible, for example, by leaving out a part of its structural elements, replacing a part of its structural elements with other elements, or adding further structural elements.

The current-voltage converter 710 is an inverting amplifier circuit that is configured by an op-amp 712 and a feedback resistor R11. The output voltage VDET of the op-amp 712 is given by the following equation:

$$V_{DET} = VREF - I_{DET} \cdot R11 \tag{4}$$

-continued $$= VREF - (VHO - VREF)\frac{R11}{R_c}$$

Here, VHO is the output voltage of the voltage application portion 320 (FIG. 6), and Rc is the combined resistance of the four resistors 701 to 704 (FIG. 10A). This output voltage VDET has a voltage value that corresponds to the detection current IDET.

It should be noted that the voltage VDET given by Equation (4) represents a value obtained by inverting the voltage (IDET·R11) due to the detection current IDET. Accordingly, it is also possible to add another inverting amplifier to the current-voltage converter 710, and let this additional inverting amplifier output the voltage obtained by inverting the voltage VDET as the output voltage of the current-voltage converter 710. It is preferable that the absolute value of the gain of this additional inverting amplifier is 1.

The voltage comparator 720 includes a threshold voltage generation portion 722, a comparator 724 (op-amp), and a switching control portion 726. The threshold voltage generation portion 722 selects, with a selector switch 723, one of a plurality of threshold voltages Vth(j) obtained by dividing the reference voltage VREF with a plurality of resistors R1 to Rm, and outputs the selected threshold voltage. The plurality of threshold voltages Vth(j) correspond to threshold values that identify the value of the detection current IDET in the 16 mounting states shown in FIG. 10B. The comparator 724 compares the output voltage VDET of the current-voltage converter 710 with the threshold voltage Vth(j) that is output from the threshold voltage generation portion 722, and outputs a binary comparison result.

Based on the result of comparing the output voltage VDET with the threshold voltage Vth(j), the switching control portion 726 controls the switching of the voltage value Vth(j) to be output next from the threshold voltage generation portion 722.

Based on the binary comparison result that is output from the voltage comparator 720, the comparison result storage portion 730 sets a flag (for example, by writing a "1") at the appropriate bit position within a bit register 734. The switching timing of the selector switch 732 is specified by the switching control portion 726. The bit register 734 includes N (e.g. N=4) cartridge detection bits that indicate whether the individual cartridges that can be mounted to the printing apparatus are mounted or not, and a malfunction flag bit that indicates that an abnormal current value has been detected. The malfunction flag bit takes on H level when a current flows that is significantly larger than the current Imax (FIG. 10B) for the state that all cartridges are mounted. However, it is also possible to omit the malfunction flag bit. The plurality of bit values that are stored in the bit register 734 are sent as the digital detection signal SIDET (detection current signal) to the CPU 410 (FIG. 4) of the main controller 400. From the bit value of this digital detection signal SIDET, the CPU 410 determines whether the individual cartridges are mounted or not. As noted above, the four bit values of the digital detection signal SIDET indicate whether the individual cartridges are mounted or not. Consequently, the CPU 410 can determine immediately from the individual bit values of the digital detection signal SIDET whether the individual cartridges are mounted or not.

The voltage comparator 720 and the comparison result storage portion 730 together constitute an A-D converter. As the A-D converter, it is possible to employ a variety of known configurations, instead of the voltage comparator 720 and the comparison result storage portion 730 shown in FIG. 11.

The voltage correction portion 740 is a circuit for tracking and correcting the plurality of the threshold voltages Vth(j) generated by the threshold voltage generation portion 722 for variations in the mounting detection voltage VHO. The voltage correction portion 740 is configured by an inverting amplification circuit including an op-amp 742 and two resistors R21 and R22. The output voltage VHO of the voltage application portion 320 is input via the input resistor R22 into the inverting input terminal of the op-amp 742, and the reference voltage VREF is input into its non-inverting terminal. In this situation, the output voltage AGND of the op-amp 742 is given by the following equation:

$$AGND = VREF - (VHO - VREF)\frac{R21}{R22} \tag{5}$$

This voltage AGND is used as the base voltage AGND on the low-voltage side of the threshold voltage generation portion 722. For example, if VREF=2.4 V, VHO=42 V, R21=20 kΩ, R22=400 kΩ, then AGND=0.42 V. As can be seen from a comparison of Equation (4) and Equation (5), the base voltage AGND on the low-voltage side of the threshold voltage generation portion 722 changes depending on the value of the output voltage VHO of the voltage application portion 320, like the detection voltage VDET. The discrepancy between the two voltages AGND and VDET is caused by the difference between the resistance ratios R21/R22 and R11/Rc. If such a voltage correction portion 740 is used, then even if the power-source voltage VHV changes for some reason, the plurality of threshold voltages Vth(j) that are generated by the threshold voltage generation portion 722 follow the variations in the power-source voltage VHV and are changed accordingly. As a result, both of the detection voltage VDET and the plurality of threshold voltages Vth(j) change following the variations of the power-source voltage VHV, so that it is possible to obtain a comparison result that represents the accurate mounting state with the voltage comparator 720. In particular, if the resistance ratio R21/R22 is set to the same value as the resistance ratio R11/Rc1 (where Rc1 is the combined resistance when all cartridges are mounted), then it is possible to let the detection voltage VDET and the plurality of threshold voltages Vth(j) change with substantially the same change amount as the variations in the power-source voltage VHV, so that they accurately track any changes in the power-source voltage VHV. However, it is also possible to omit the voltage correction portion 740.

In the above-described configuration example, the first individual mounting detection terminal DT1 is connected to the voltage application portion 320, and the second individual mounting detection terminal DT2 is connected to the individual mounting detection portion 330, but it is also possible to switch the connections around so that DT1 is connected to the individual mounting detection portion 330 and DT2 is connected to the voltage application portion 320.

It should be noted that various embodiments have been explained in detail, the person skilled in the art will appreciate that numerous variations and modifications are possible that do not deviate substantially from the novel aspects and effect of the invention. Consequently, those variations and modifications are also to be included within the scope of the invention. For example, terms that are used within the description or drawings at least once together with broader terms or alternative terms can be replaced also at other locations within the description or drawings by those other terms. Also the configuration and operation of the printing apparatus are not limited to those explained in the embodiments, and various modifications are possible.

The entire disclosure of Japanese Patent Application No. 2011-242402, filed on Nov. 4, 2011 is expressly incorporated herein by reference.

What is claimed is:

1. A printing apparatus comprising:

a printing material container including a storage device, a plurality of storage device terminals that are connected to the storage device, a first individual mounting detection terminal, a second individual mounting detection terminal, a first cartridge out detection terminal, and a second cartridge out detection terminal;

an individual mounting detection portion that is connected to the second individual mounting detection terminal and that individually detects one of a mounted state and a non-mounted state of the printing material container;

a cartridge out detection portion that is connected to the first cartridge out detection terminal and the second cartridge out detection terminal, and that detects a cartridge out state of the printing material container;

a storage portion that stores a detection result in case that the cartridge out detection portion detects a cartridge out state; and a controller that, in an energy-saving mode, sets the individual mounting detection portion to a disabled state and sets the cartridge out detection portion to an enabled state, and if the cartridge out detection portion detects a cartridge out state, writes a detection result to the storage portion, when returning from the energy-saving mode to a regular mode, sets the individual mounting detection portion to the enabled state and accesses the storage portion, and if the detection result is stored in the storage portion, determines that the cartridge out state is present, even when the cartridge out detection portion does not detect a cartridge out state.

2. The printing apparatus according to claim 1, wherein, in the regular mode, if the individual mounting detection portion detects the non-mounted state of the printing material container, the controller outputs identification information of the printing material container determined to be in the non-mounted state.

3. The printing apparatus according to claim 1, comprising a plurality of the printing material containers to be detected by the individual mounting detection portion, wherein, in the regular mode, if the individual mounting detection portion detects the mounted-state of the plurality of printing material containers to be detected, and the cartridge out detection portion detects a cartridge out state, the controller accesses the storage devices of the plurality of printing material containers to be detected, determines that each of the printing material containers whose storage device cannot be accessed is in the non-mounted state, and outputs identification information of each of the printing material containers determined to be in the non-mounted state.

4. The printing apparatus according to claim 3, wherein, if the controller can access all of the storage devices of the plurality of printing material containers to be detected, or cannot access any of the storage devices of the plurality of printing material containers to be detected, the controller outputs identification information of the plurality of printing material containers to be detected.

5. The printing apparatus according to claim 2, wherein the controller displays on a display portion mounting information as to one of the mounted state and the non-mounted state of the printing material container, based on the identification information.

6. The printing apparatus according to claim 1, further comprising a voltage application portion for applying a mounting detection voltage to the first individual mounting detection terminal;

wherein the printing material container includes a mounting detection resistor element that is provided between the first individual mounting detection terminal and the second individual mounting detection terminal; and the individual mounting detection portion individually detects one of the mounted state and the non-mounted state of the printing material container, based on the mounting detection voltage and a current that flows through the mounting detection resistor element.

7. The printing apparatus according to claim 1, comprising the first to n-th printing material containers (where n is an integer of 2 or greater) to be detected by the cartridge out detection portion, the cartridge out detection portion including a first terminal that is connected to the first cartridge out detection terminal of the first printing material container, and a second terminal that is connected to the second cartridge out detection terminal of the n-th printing material container, the first cartridge out detection terminal of the i-th printing material container (where "i" is an integer with $1<i<n$) among the first to n-th printing material containers being connected to the second cartridge out detection terminal of the (i−1)-th printing material container, the second cartridge out detection terminal of the i-th printing material container being connected to the first cartridge out detection terminal of the (i+1)th printing material container, and the cartridge out detection portion detecting a cartridge out state by detecting electrical conduction between the first terminal and the second terminal.

8. The printing apparatus according to claim 1, wherein a voltage used by the individual mounting detection portion for individually detecting one of the mounted state and the non-mounted state of the printing material container is higher than a voltage used by the cartridge out detection portion for detecting the cartridge out state of the printing material container.

* * * * *